US007016638B2

(12) United States Patent
Ono et al.

(10) Patent No.: US 7,016,638 B2
(45) Date of Patent: Mar. 21, 2006

(54) IMAGE HEATING APPARATUS AND IMAGE FORMING APPARATUS

(75) Inventors: Kazuaki Ono, Kashiwa (JP); Masayoshi Kachi, Abiko (JP); Daigo Matsuura, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 108 days.

(21) Appl. No.: 10/763,271

(22) Filed: Jan. 26, 2004

(65) Prior Publication Data

US 2004/0202498 A1 Oct. 14, 2004

(30) Foreign Application Priority Data

Jan. 24, 2003 (JP) ..... 2003-016083

(51) Int. Cl.
*G03G 15/20* (2006.01)

(52) U.S. Cl. ..... 399/329; 399/330; 399/331

(58) Field of Classification Search ..... 399/320, 399/321, 322, 323, 328, 329, 330, 331, 333; 219/216; 216/219
See application file for complete search history.

(56) References Cited

U.S. PATENT DOCUMENTS 5,438,398 A 8/1995 Tanigawa et al. ..... 355/271
5,519,475 A 5/1996 Miyamoto et al. ..... 355/271
5,682,576 A 10/1997 Sakai et al. ..... 399/69
5,940,668 A 8/1999 Tanigawa et al. ..... 399/302
6,597,888 B1 * 7/2003 Abe et al. ..... 399/329
6,603,947 B1 * 8/2003 Katayanagi et al. ..... 399/333
6,614,004 B1 9/2003 Moriya et al. ..... 219/216
6,795,676 B1 * 9/2004 Kikuchi et al. ..... 399/323
6,795,678 B1 * 9/2004 Yura et al. ..... 399/329

* cited by examiner

*Primary Examiner*—Hoan Tran
(74) *Attorney, Agent, or Firm*—Fitzpatrick, Cella, Harper & Scinto

(57) ABSTRACT

An image forming apparatus has a both-side image forming unit for forming images on both sides of a recording material; a rotatable belt for heating a toner image on a recording material through a belt; a rotatable supporting member, having an elastic layer, for supporting the belt; a rotatable pressing member, pressed toward the supporting member with the belt interposed therebetween, for forming the nip for nipping and feeding the recording material; the pressing member has a surface hardness which is larger than a surface hardness of the rotatable supporting member, wherein a surface hardness of the rotatable supporting member through the belt is different from a surface hardness of the pressing rotatable member by +4 degrees to −8 degrees.

7 Claims, 5 Drawing Sheets

IMAGE HEATING APPARATUS AND IMAGE FORMING APPARATUS

FIELD OF THE INVENTION AND RELATED ART

The present invention relates to a heating apparatus, and an image forming apparatus employing a heating apparatus as a fixing apparatus. Here, a heating apparatus means an apparatus which comprises: a flexible belt which is movable while being heated by a heating means; a backup member for backing up the flexible belt; and a pressuring member for pressuring the backup member against the back member in order to form a compression nip, with the flexible belt sandwiched between the backup member and pressuring member, and which heats an object with the heat from the flexible belt, by guiding the object between the pressuring member and flexible belt, in the compression nip.

A heating apparatus of a heat belt type is used as a fixing apparatus for fixing a toner image to recording medium. It is used to apply heat and pressure to an unfixed toner image formed on recording medium, in an image forming apparatus of an electrophotographic type, or the like (copying machine, facsimileing machine, printer, etc.). It is also used as a fixing apparatus for temporarily fixing an unfixed image to recording medium, or an image heating apparatus for improving the surface properties or a recording medium on which a fixed image is borne.

Next, for reasons of expediency, an image heating apparatus will be described with reference to fixing apparatuses for an image forming apparatus. There are two types of image heating apparatuses most commonly employed as a fixing apparatuses for an image forming apparatus, such as a copying machine, a facsimileing machine, or a printer.

1) Heat Roller Type Fixing Apparatus

In an image forming apparatus, an image (unfixed image) is directly or indirectly formed of toner particles on recording medium (transfer sheet, electro-facsimile sheet, electrostatic recording paper, OHP sheet, printing paper, formatted paper, envelope, etc.), in the image formation station with the use of an optional image forming process among an electrophotographic process, an electrostatic recording process, a magnetic recording process, etc., in accordance with image formation data. The unfixed toner image must be fixed to the recording medium. As the means for fixing the unfixed image (toner image) to the recording medium, a heat roller type fixing apparatus is widely in use, which applies heat and pressure to fix the unfixed image.

A heat roller type fixing apparatus essentially comprises a heat roller as a fixation roller, and a pressure roller as a pressing roller. The heat roller internally holds a heat source such as a halogen heater. The pressure roller is kept pressed upon the heat roller, creating a pressure nip (fixation nip). As the two rollers are rotated, a recording medium, on which an unfixed image is borne, is nipped into the pressure nip (fixation nip) and conveyed through it. While the recording medium and the unfixed image thereon are conveyed through the pressure nip (fixation nip), the unfixed image is permanently fixed to the recording medium by the heat applied from the heat roller and the pressure in the nip.

Not only is a heat roller type fixing apparatus employed by many monochromatic image forming apparatuses, but also by many full-color image forming apparatuses. Compared to an image formed by a monochromatic image forming apparatus, an image formed by a full-color image forming apparatus is thicker (in terms of toner layer), being therefore greater in the amount of the toner having adhered to the recording medium. Therefore, a heat roller type fixing apparatus for a full-color image forming apparatus is desired to be as wide in fixation nip (fixation nip width; dimension of fixing nip in terms of recording medium conveyance direction) as possible so that a toner image (unfixed) formed on recording medium is heated for as long time and at as low a temperature as possible in the fixation nip.

Further, a fixing apparatus is used for improving recording medium in glossiness, improving an image on OHP in transparency color reproducibility, or the like purposes. Thus, for the same reason as the one given above, a heat roller type fixing apparatus comprising a heat roller (fixation roller) and a pressure roller, the peripheral layer of which is formed of heat resistant elastic material, and the peripheral surface of which is highly smooth, or even as smooth as a mirror surface, has become the mainstream fixing apparatus for a full-color image forming apparatus, because it is capable or uniformly melting the toner layer in order to flatten the surface of the toner layer surface to improve the toner image in glossiness.

However, increasing the diameters of the rollers of a heat roller type fixing apparatus for a full-color image forming apparatus in order to increase the nip width thereof, is problematic in that it increases the size of the fixing apparatus, which in turn increases the overall size of the image forming apparatus. Further, increasing the thickness of the heat resistant elastic layer of the fixation roller in order to increase the nip width reduces the thermal conductivity of the layer in terms of the radius direction of the roller, reducing thereby the speed at which heat is conducted from the heat source to the peripheral surface of the fixation roller. The reduction in the heat conduction speed from the heat source of the peripheral surface of the fixation roller results in the reduction in the surface temperature of the peripheral surface thereof, which results in fixation failure in that the unfixed toner particles fail to be solidly adhered to the recording medium. In other words, increasing the rollers in diameter, and/or increasing the thickness of the elastic layers of the rollers makes it necessary to reduce the fixing apparatus in throughput in order to properly fix images, making it thereby impossible for the fixing apparatus to cope with a job with a large throughput (in terms of print count per unit of time).

Thus, one of the essential obstacles to be overcome in order to realize a fixing apparatus for a full-color image forming apparatus, which is smaller, faster (and therefore higher in throughput), is to increase the nip width without reducing the speed at which heat is conducted from a heat source to the peripheral surface of the fixation roller. However, there are only a limited number of methods for increasing the nip width in a heat roller type fixing apparatus, which are to increase the diameters of the aforementioned rollers and/or, to increase the thickness of the heat resistant layer of each roller. In other words, there is a limit to the number of solutions to the above described problem while using a heat roller type fixing apparatus.

2) Fixing Belt Type (Heating Belt Type) Fixing Apparatus

Thus, a fixing belt type fixing apparatus, in which a fixing belt is kept pressed upon a pressure roller to form a nipping portion, has been proposed as a solution for overcoming the limits of a thermal roller type fixing apparatus.

In the case of a fixing belt type fixing apparatus, the heat source is located away from a fixing roller to reduce the warm-up time. More specifically, a fixing belt, which is an endless belt, is suspended between an elastic fixation roller and a heat roller, with the fixing belt sandwiched between the fixation roller and a pressure roller. A recording medium bearing an unfixed image is conveyed through the pressure nip between the fixation roller and pressure roller, in order to permanently fix the unfixed image to the recording medium by the heat from the fixation belt and the pressure of the fixation nip.

The nip width of a fixing belt type fixing apparatus is easier to increase by softening the elastic fixation roller thereof than that of a heat roller type fixing apparatus. Further, the fixing belt of a fixing belt type fixing apparatus, which is heated by a heat roller, is smaller in thermal capacity than a heat roller. Therefore, it quickly heats up, making it possible to satisfactorily heat recording medium without being reduced in the speed at which heat is conducted from a heat source to the heating surface. In other words, a fixing belt type fixing apparatus is advantageous over a heat roller type fixing apparatus in that not only can the former reduce the warm-up time, but also makes it possible to provide a smaller fixing apparatus capable of fixing an image at a higher speed.

In the case of a fixing belt type fixing apparatus, in accordance with the prior art, for an image forming apparatus, the elastic layer of the fixation roller thereof is reduced in hardness in order to widen the fixing nip, and the elastic layer of the pressure roller is reduced in thickness in order to make the pressure roller faster in startup speed. The reduction in the thickness of the elastic layer of the pressure roller makes the pressure roller harder.

If the elastic layer of the pressure roller is harder than a certain degree, the fixing nip is formed in such a manner that its cross section perpendicular to the axial line of the fixation roller (pressure roller) and fixing belt bows toward the fixation roller. This creates a problem when fixing two toner image on both sides, one for one, of a recording medium. That is, when fixing the toner image on the first side of the recording medium, the toner image will separate from the fixing belt with no problem after it is fixed to the recording medium, however, when fixing the toner image on the second side of the recording medium, the toner image does not easily separate from the pressure roller, that is, it is slow to separate from the pressure roller, sometimes causing the recording medium to wrap around the pressure roller, after it is fixed to the recording medium.

In comparison, Increasing the elastic layer of the fixation roller in hardness and reducing the elastic layer of the pressure roller in hardness in order to widen the fixation nip makes the cross section of the fixation nip bow toward the pressure roller. This also creates a problem when fixing two toner images to both surfaces, one for one, of a recording medium. That is, when fixing the toner image on the first surface of the recording medium, the toner image does not easily separate from the fixing belt, that is, it is slow to separate from the fixing belt, sometimes causing the recording medium to wrap around the fixing belt, after it is fixed to the recording medium, although when fixing the toner image on the second surface of the recording medium, the toner image separates from the fixing belt with no problem, after it is fixed to the recording medium.

As will be evident from the problematic phenomena described above, not only is the cross sectional shape of the fixing nip affected by the hardness of the surface of the fixation roller and the hardness of the surface of the pressure roller, but also, it is substantially affected by the structure of the fixing belt.

As one of the measures for dealing with the above described separation problem, there is a structural arrangement that places separation claws in contact with the fixing belt or pressure roller to mechanically separate the recording medium from the fixing belt or pressure roller.

This measure solves the problem that a recording medium wraps around the fixing belt or pressure roller, but brings forth a different problem. That is, as a recording medium which is slow to separate from the fixing belt or pressure roller comes into contact with the separation claws, the toner image (toner particles) having been welded to the recording medium come into contact with the separation claws. As a result, the toner image is reduced in quality. For example, the image becomes nonuniform in glossiness or streaky, or is sometimes peeled away from the recording means. Therefore, when separation claws are placed in contact with the fixing belt or pressure roller, it is required to convey a recording medium in such a manner that this problem will not occur.

SUMMARY OF THE INVENTION

The primary object of the present invention is to provide a heating belt type image heating apparatus which does not employ a separation claw, but is capable of preventing recording medium from failing to separate from the fixing belt or pressure roller.

According to an aspect of the present invention, there is provided an image forming apparatus comprising a both-side image forming means for forming images on both sides of a recording material; a rotatable belt for heating a toner image on a recording material through a belt; a rotatable supporting member, having an elastic layer, for supporting the belt; a rotatable pressing member, pressed toward the supporting member with the belt interposed therebetween, for forming the nip for nipping and feeding the recording material; the pressing member has a surface hardness which is larger than a surface hardness of the rotatable supporting member, wherein a surface hardness of the supporting rotatable member through the belt is different from a surface hardness of the pressing rotatable member by +4 degrees to −8 degrees.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS (Embodiment 1)

(1) Image Forming Apparatus

Figure 1:
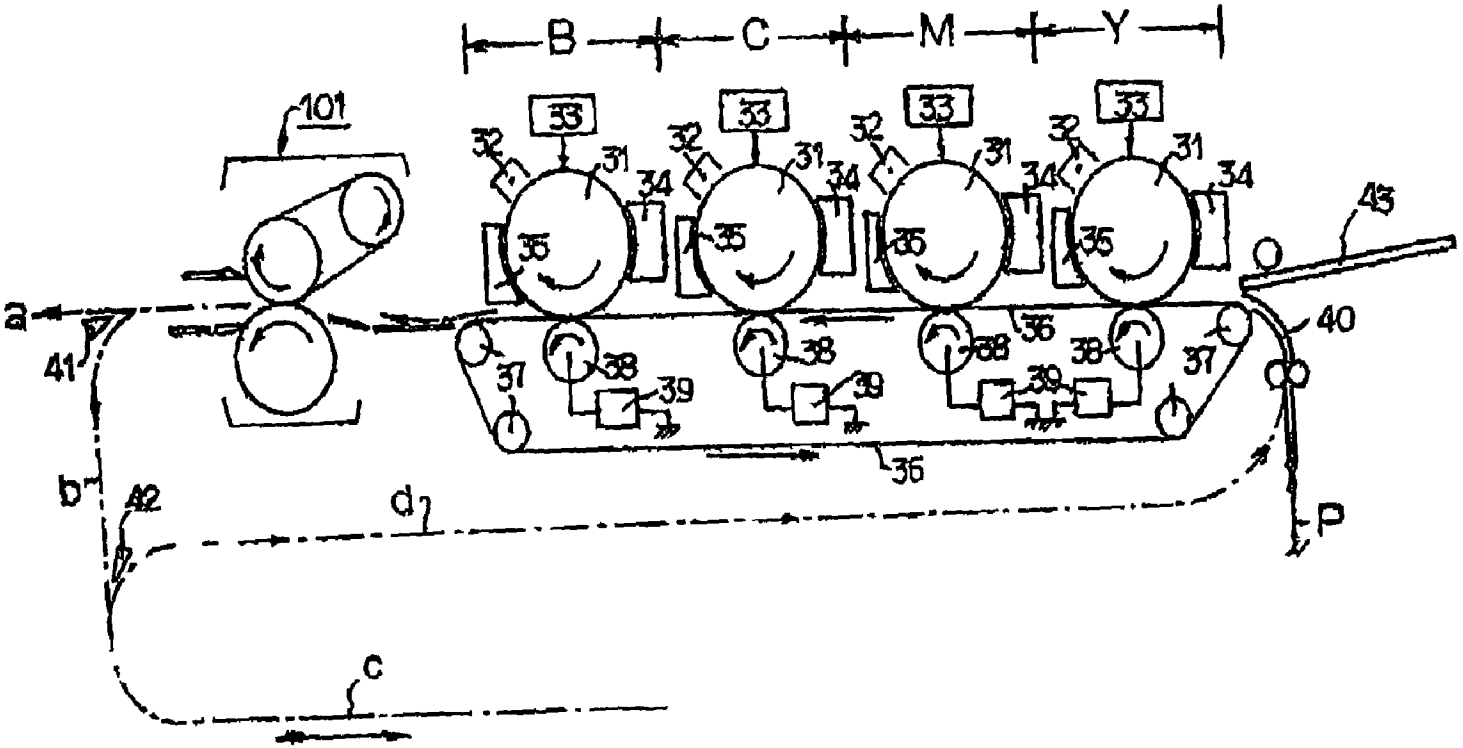
FIG. 1 is a schematic sectional view of the image forming apparatus in accordance with the present invention, showing the general structure thereof.

FIG. 1 is a schematic sectional view of a typical image forming apparatus equipped with a heating apparatus in accordance with the present invention, showing the general structure thereof. The image forming apparatus in this embodiment is an electrophotographic full-color image forming apparatus. It is of a tandem type; in other words, it is capable of automatically forming an image on both sides of a recording medium.

Referential symbols Y, M, C, and B designate the first to fourth image forming stations positioned in the listed order from the right to left in the drawing.

Each image forming station is an electrophotographic image formation mechanism comprising: an electrophotographic photosensitive member 31 as an image bearing member in the form of a rotatable drum; a charging apparatus 32; an exposing apparatus 33 comprising a laser scanner, an LED array, etc.; a developing apparatus 34; a cleaning apparatus 35; etc. The photosensitive member 31 is rotationally driven in the clockwise direction indicated by an arrow mark at a predetermined peripheral velocity.

The first image forming station Y forms on the peripheral surface of the photosensitive member 31 a toner image corresponding to the yellow component of an intended full-color image. The second image forming station M forms on the peripheral surface of the photosensitive member 31 a toner image corresponding to the magenta component of the intended full-color image. The third image forming station C forms on the peripheral surface or the photosensitive member 31 a toner image corresponding to the cyan component of the intended full-color image. The fourth image forming station B forms on the peripheral surface of the photosensitive member 31 a toner image corresponding to the black component of the intended full-color image. The charging process, developing process, and cleaning process are carried out in each of the four image forming stations.

Designated by a referential number 36 is a transfer belt suspended by a plurality of support rollers 37, being thereby stretched below the first to fourth image formation stations Y, M, C, and B. The transfer belt 36 is circularly driven in the counterclockwise direction indicated by an arrow mark at the same peripheral speed as that of the photosensitive member 31.

Designated by a referential number 38 is a transfer roller as an electrode. There are four transfer rollers 38, which are kept pressed against the bottom sides of the photosensitive member 31, forming transfer nips, with the transfer belt 36 sandwiched between the photosensitive members 31 and transfer rollers 38, one for one. Designated by a referential number 39 is a transfer bias application power source. There are a plurality of power sources 39, which are the power sources connected to the transfer rollers 38 one for one in order to apply a predetermined amount of voltage opposite in polarity to the polarity of the charged toner, to the transfer rollers 38 with predetermined timings.

Designated by a referential number 40 is a sheet conveyance path, through which recording mediums (transfer medium) P fed one by one into the main assembly of the image forming apparatus from the unshown sheet feeding mechanism are conveyed to the end of the elongated loop formed by transfer belt 36, on the first image formation station (Y) side. Designated by a referential number 43 is a manual sheet feeder tray, through which a recording medium P can be manually fed into the apparatus main assembly.

The transfer belt 36 holds a fed recording medium P, while keeping the recording medium P adhered thereto electrostatically or with the use of chucks, and sequentially conveys the recording medium P through the first to fourth image forming stations Y, M, C, and B, starting from the first station, so that a yellow toner image, a magenta toner image, a cyan toner image, and a black toner image are sequentially transferred in layers onto a single recording medium P to form a synthetic full-color image.

After being conveyed through the transfer nip of the fourth image forming station B, the recording medium P is separated from the transfer belt 36, and then, is guided into a fixing apparatus 101, in which the unfixed toner images are thermally fixed to the recording medium P.

When the image forming apparatus is in the monochromatic printing mode, only the fourth image forming station 4, which is for forming a black toner image, is activated.

When the image forming apparatus is in the one-sided printing mode, the recording medium P is discharged out of the apparatus main assembly through a sheet path a, after coming out of the fixing apparatus 101.

When the image forming apparatus is in the automatic two-sided print mode, the flapper 41 is switched in position so that after the recording medium P, the first surface of which is bearing a fixed image, comes out of the fixing apparatus 101, it is guided into the sheet path b of the mechanism for recirculating the recording medium, which leads to the switchback path c of the mechanism. Then, the flapper 42 is switched in position to guide the recording medium P into the sheet path d. As a result, the recording medium P is placed upside down on the transfer belt 36, and conveyed again to the upstream end of the first image forming station Y. Thereafter, the recording medium P catches the toner images, on the second surface thereof, and is reintroduced into the fixing apparatus 101, in which the toner images on the second surface of the recording medium P are fixed. Thereafter, the recording medium P is discharged from the fixing apparatus 101, and is discharged out of the apparatus main assembly through the sheet path a.

(2) Fixing Apparatus 101

Figure 2:
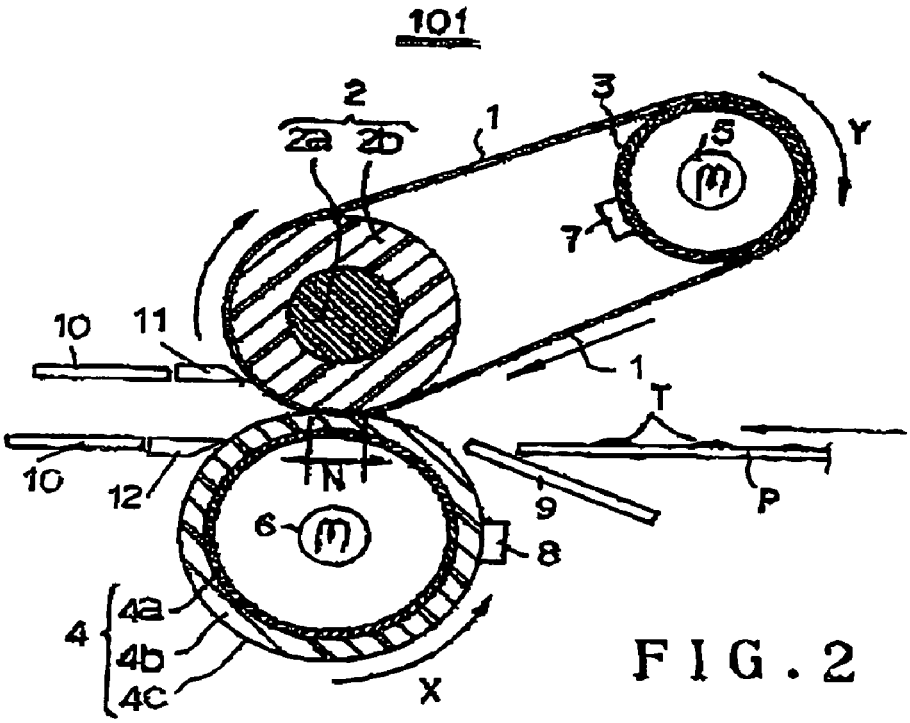
FIG. 2 is a schematic sectional view of the fixing apparatus in the first embodiment of the present invention, showing the general structure thereof.

FIG. 2 is a schematic sectional view of the heating apparatus as the fixing apparatus 101 in this embodiment, showing the general structure thereof.

This fixing apparatus 101 is a belt type fixing apparatus comprising: a fixation roller 2, a heat roller 3, an endless fixation belt 1, and a pressure roller 4. The fixation roller 2 is an elastic and rotational cylindrical member, it supports and backs up the fixation belt 1. The heat roller 3 is a roller for heating the fixation belt 1. The endless fixation belt 1 is flexible member which is circularly movable. It is stretched around the fixation roller 2 and heat roller 3, being given a predetermined amount of tension. The pressure roller 4 is a rotational member, and is kept pressured against the fixation roller 2, forming thereby a fixation nip N, with the fixation belt 1 being sandwiched between the pressure roller 4 and fixation roller 2. The heat roller 3 and pressure roller 4 internally hold heaters 5 and 6, respectively, for heating the fixation belt 1. In operation, a recording medium P is conveyed between the pressure roller 4 and fixation belt 1, in the aforementioned nipping portion (fixation nip) N. While the recording medium P is conveyed through the fixation nip N, an unfixed toner image T borne on the recording medium P is fixed to the recording medium P by the combination of the heat from the fixation belt 1 heated by the heat roller 3 heated by the heater 5, the heat from the pressure roller 3 heated by the heater 6, and the pressure in the fixation nip N.

In this embodiment, the pressure roller 4 is rotatably supported by its lengthwise ends, with bearings, or the like, solidly attached to the main assembly of the fixing apparatus 101. The fixation roller 2 is also rotatably supported by its lengthwise ends, with bearings, or the like, attached to an unshown pressure application mechanism, such as a springs, of the main assembly of the fixing apparatus 101, being thereby enabled to be pressed against the pressure roller 4, with the fixation belt 1 being sandwiched between the two rollers. The fixation roller 2 and pressure roller 4 are kept pressured against each other, forming thereby the fixation nip N between them, in which the toner image T on the recording medium P is thermally melted and is subjected to the pressure from the fixation nip N, while the recording medium bearing the unfixed toner image T is inserted and conveyed through the fixation nip N. While the recording is conveyed between the two rollers 2 and 4, the toner image T is thermally melted while being subjected to the pressure in the fixation nip N. As for the heat roller 3, it is rotatably supported by its lengthwise ends, with bearings, or the like, and is kept pressured as a tension roller by a pressure application mechanism or the like in the direction to provide the fixation belt 1 with a predetermined amount of tension.

The fixation belt 1, fixation roller 2, heat roller 3, and pressure roller 4 are rotationally driven by a power source.

In this embodiment, the pressure roller 4 is rotated in the direction indicated by an arrow mark X by the power source of the main assembly of the image forming apparatus. As the pressure roller 4 is rotationally driven, the fixation belt 1 is circularly moved in the direction indicated by an arrow mark Y by the rotation of the pressure roller 4 because of the presence of the friction between the peripheral surface of the pressure roller 4 and the inward surface of the fixation belt 1. As a result, the fixation roller 2 and heat roller 3 are rotated by the fixation belt 1 because of the presence of the friction between the inward surface of the fixation belt 1 and the peripheral surface or the fixation roller 2, and the friction between the inward surface of the fixation belt 1 and the peripheral surface of the heat roller 3, respectively. In other words, the fixing apparatus 101 employs such a pressure roller driving mechanism that as the pressure roller 4 is rotationally driven, the fixation belt 1, fixation roller 2, and heat roller 3 are rotated by the rotation of the pressure roller 4 at roughly the same peripheral velocity as that of the pressure roller 4. Thus, while a recording medium P is conveyed through the fixation nip N, the fixation belt 1, fixation roller 2, and heat roller 3 are driven by the rotation of the pressure roller 4 because of the presence of the friction between the pressure roller 4 and recording medium P, and the friction between the pressure roller 4 and fixation belt 1.

To describe in more detail, the fixation roller 2 and pressure roller 4 are connected by the one-way gear attached to one or the lengthwise ends of the fixation roller 2, and the gear attached to the lengthwise end of the pressure roller 4, located on the same side as the one-way gear of the fixation roller 2. Thus, even if slipping occurs directly between the pressure roller 4 and fixation belt 1, or indirectly between the pressure roller 4 and fixation belt 1 with the presence of the recording medium P between the roller 4 and belt 1, the pressure roller 4 and fixation belt 1 rotate at roughly the same peripheral speeds, because the fixation roller 2 is being rotationally driven through the above described one-way gear. In other words, the fixing apparatus 101 is designed in anticipation of the slipping.

Disposed on the upstream and downstream sides, in terms of the recording medium conveyance direction, of the pressure roller 4 are an entrance guide 9 and discharge guide 10, as guiding members, respectively, which make up parts of the recording medium conveyance path, through which the recording medium P bearing the toner image T, is conveyed.

Disposed on the downstream side of the fixation nip N, in terms of the recording medium conveyance direction, are either a set of top separation claws 11 or a set of bottom claws 12, or both sets, as means for mechanically separating a recording medium P from the fixation belt 1 and pressure roller 4, if the toner image T on the recording medium P fails to normally separate from the fixation belt 1 and pressure roller 4, respectively. The top and bottom separation claws 11 and 12 are kept in contact with the fixation belt 1 and pressure roller 4, respectively, with the application of predetermined amounts of pressure. In this embodiment, both the set of top separation claws 11 and the set of bottom separation claws 12 are provided.

1) Fixation Belt 1

In order to improve the fixation belt 1 in terms of the startup speed by reducing the fixation belt 1 in thermal capacity, the thickness of the fixation belt 1 is desired to be no more than 150 $\mu$m, preferably, in the range of 30–80 $\mu$m. It may be an endless belt formed of a single layer of heat resistant substance, more specifically, fluorinated resin such as PTFE, PFA, FEP, etc., or a multilayer endless belt comprising a base layer formed essentially of a resinous substance such as polyimide, polyamide-imide, polyether-ether-ketone (PEEK), polyether-sulfone (PES), polyphenylene-sulfide (PPS), etc., or metallic substance such as stainless steel (SUS), and a release layer formed of essentially a fluorinated resin, such as polytetrafluoroethylene (PTFE), perfluoroalkoxyl alkane (PFA), tetrafluoroethylene (FEP), etc., on the outward surface of the base layer.

As the fixation belt 1 for a full-color image forming apparatus, a multilayer endless belt or the like comprising the aforementioned base layer, and a 100 $\mu$m–800 $\mu$m thick heat resistant elastic layer formed of silicone rubber, fluorinated rubber, or the like, on the base layer, may be used, in order to uniformly melt the toner image surface to smooth it to give the toner image a highly glossy appearance. In such a case, in order to prevent the toner image T from offsetting, by making it easier for the fixation belt 1 to release the toner image T on the recording medium P, it is necessary to provide the fixing apparatus with an oil coating apparatus for coating the fixing belt 1 with oil.

Instead, a multilayer belt comprising the above described multilayer fixation belt 1, and a release layer formed on the peripheral surface of the heat resistant elastic layer, of essentially a fluorinated resin such as PTFE, PFA, FEP, etc., may be employed as a fixation belt. In this case, the oil coating apparatus, with which the fixing apparatus which does not have a release layer needs to be provided in order to coat the fixing belt 1 with oil, can be eliminated making it possible to reduce the cost of the fixing apparatus.

The fixing apparatus in this embodiment is an oil-free fixing apparatus having 1) a fixation belt 1 which is 370 μm in overall thickness and 60 mm in internal diameter, and comprises: a 40 μm thick base layer formed of polyimide resin; a 300 μm thick heat resistant layer formed of silicone rubber with a hardness of 20° (JIS-A), on the peripheral surface of the base layer; and a 30 μm thick release layer formed of PFA tube, on the peripheral surface of the heat resistant layer; or 2) a fixing belt 1 which is 370 μm in overall thickness and 60 mm in internal diameter, and comprises: a 40 μm thick base layer formed of stainless steel (SUS); a 300 μm thick heat resistant layer formed of silicone rubber with a hardness of 20° (JIS-A), on the peripheral surface of the base layer; and a 30 μm thick release layer formed of PFA tube, on the peripheral surface of the heat resistant layer.

2) Fixation Roller 2

The fixation roller 2 comprises a metallic core 2*a*, and a heat resistant layer 2*b* formed on the peripheral surface of the metallic core 2*a*, of silicone rubber, fluorinated rubber, silicone sponge reduced in heat conductivity to raise faster the temperature of the fixing belt 1, or the like.

The fixation roller 2 used in this embodiment is such a fixation roller that is roughly 30 mm in external diameter and comprises a metallic (iron) core 2*a* with a diameter of 14 mm, and an 8 mm thick sponge layer 2*b* formed on the peripheral surface of the metallic core 2*a*, of silicone sponge with a thermal conductivity of 0.08 [W/m·° C.].

3) Heat Roller 3

In order to improve the startup speed of the heat roller 3 which internally holds the heater 5, the heat roller 3 is reduced in thermal capacity by being formed of a metallic pipe which is small in diameter and thin in wall, and the main ingredient of which is metallic substance such as aluminum or iron which is superior in thermal conductivity.

The fixation belt 1 is heated by the heater 5 through the heat roller 3. The surface temperature of the fixation belt 1 is maintained at a predetermined level by controlling the temperature of the heat roller 3 by turning on or off the heater 5 in response to the temperature of the heat roller 3 detected by a temperature detection element (thermistor) 7.

The heat roller 3 used in this embodiment is an aluminum roller with a wall thickness of 1 mm and an external diameter of 24 mm, and the heater 5 used in this embodiment is a halogen heater.

4) Pressure Roller 4

The pressure roller 4 way be made up of a metallic core 4*a* and a heat resistant elastic layer 4*b* formed on the peripheral surface of the metallic core 4*a*, of such a substance as silicone rubber or fluorinated rubber, or made up of a metallic core 4*a*, a heat resistant elastic layer 4*b* formed on the peripheral surface of the metallic core 4*a*, of such a substance as silicone rubber or fluorinated rubber, and a fluorinated resin layer formed on the peripheral surface of the heat resistant elastic layer, of such a fluorinated resin as PTEF, PFA, FEP, etc., in order to render the pressure roller 4 superior in toner releasing properties. In the case of the former, it needs to be coated with oil, making it necessary to provide the fixing apparatus with an oil coating apparatus, whereas in the case of the latter, it does not need to be coated with oil, making it unnecessary to provide the fixing apparatus with an oil coating apparatus.

The pressure roller 4 employed in this embodiment is a roller with an overall external diameter of 40 mm, and comprises a metallic core 4*a* with a wall thickness of 1 mm, a 3 mm thick heat resistant elastic layer 4*b* formed on the peripheral surface of the metallic core 4*a*, of silicone rubber, and a 50 μm thick release layer 4*c* formed on the heat resistant elastic layer 4*b*, of a PFA tube. Therefore, the fixing apparatus does not require an oil coating apparatus.

Further, in order to increase the speed at which the fixing belt 1 starts up, a halogen heater is employed as the heater 6 to be internally held by the pressure roller 4. The temperature of the pressure roller 4 is controlled by turning on or off the heater 6 in response to the temperature or the pressure roller 4 detected by a temperature detection element (thermistor) 8. However, the pressure roller does not need to be provided with the heater 6, making the heater 5 the only heat source.

5) Toner

As for the choices of toner, in order to prevent "cold offset" and "hot offset", and to make, easier the separation of the recording medium from the fixation belt 1 and pressure roller 4, toner which contains oil, internally or externally, may be employed. In this embodiment, toner which internally contains oil is employed, making it unnecessary to provide the fixing apparatus with an oil coating apparatus.

(3) Measure for Preventing Recording Medium Separation Failure

In the case of a belt type fixing apparatus in accordance with the prior art, the toner image T on a recording medium P sometimes fails to separate from the fixation belt 1 or pressure roller 4, creating the following problem. That is, as the toner image T fails to separate from the fixation belt 1 or pressure roller 4, the recording medium P is sometimes severely scratched by the top separation claw 11 or bottom separation claw 12, respectively, after the recording medium P passes the fixation nip N. As the recording medium P is scratched, it becomes nonuniform in glossiness or streaky, or the toner image T thereon is peeled away. These problems, that is, the separation failure and the resultant scratches by the separation claws, are more likely to occur when recording medium is less in rigidity, more specifically, when recording is made under the condition in which recording medium (paper) is reduced in rigidity, that is, when recording is made in a high temperature-high humidity environment, when a recording medium is thin, and/or a recycled paper. Further, they are more likely to occur when the amount of the toner on a recording medium P is greater.

In the case of an ordinary heat roller type fixing apparatus in accordance with the prior art, generally, the hardness of the surfaces of the fixation roller and pressure roller is set so that the cross section of the fixation nip between the fixation roller and pressure roller becomes roughly straight.

On the other hand, it became evident from the studies made by the inventors of the present invention that in the case of a belt type fixing apparatus, not only must the surface hardness be properly set for the fixation roller 2 and pressure roller 4, but also for the fixation belt 1.

To describe the studies in more detail, the fixing apparatus 101 employed in the studies was 297 mm (A3 size, fed lengthwise) in the maximum paper size, 104 m/sec in recording medium conveyance speed, 300 N (roughly 30 Kgf) in the overall pressure (total of pressures applied at lengthwise ends) applied by a pressure application mechanist to the lengthwise ends of the fixation roller 2 and pressure roller 4, with the fixation belt 1 sandwiched between the two rollers, and 6 mm in fixation nip width. The temperature and humidity were 30° C. and 80%, respectively. The recording medium P was recycled paper with a weight of 64 g/m$^2$. The surface temperature of the fixation belt 1 was set to 180° C. Presuming that a full-color image was formed, the amount by which toner T was to be deposited onto the recording medium P was set to 1.2 mg/cm$^2$. The margin on the leading end (distance from leading edge of recording medium P to toner image T) was set to 2 mm. This fixing apparatus 101 was used to test the aforementioned two types of fixation belts 1: the fixing belt having the polyimide (PI) base layer, and the fixing belt having the SUS base layer, while varying the surface hardness of the fixation roller 2 and pressure roller 4. The presence or scratches made by the separation claws was deemed as the proof of the separation failure.

The results of the studies are given in Tables 1 and 2.

TABLE 1

| BASE MAT. OF BELT | HRD. (DEG) | HRD. WITH BELT (DEG) | PRESS. RLR HRD. (DEG) | CHAFF AT FIX. BELT | CHAFF AT PRESS. RLR |
|---|---|---|---|---|---|
| PI | 10 | 50 | 60 | ○ | X |
| | 14 | 52 | 60 | ○ | ○ |
| | 18 | 54 | 60 | ○ | ○ |
| | 22 | 56 | 60 | ○ | ○ |
| | 26 | 58 | 60 | ○ | ○ |
| | 30 | 60 | 60 | ○ | ○ |
| | 34 | 62 | 60 | ○ | ○ |
| | 38 | 64 | 60 | ○ | ○ |
| | 42 | 66 | 60 | X | ○ |
| | 46 | 68 | 60 | X | ○ |
| | 50 | 70 | 60 | X | ○ |
| SUS | 10 | 65 | 70 | ○ | ○ |
| | 14 | 66 | 70 | ○ | ○ |
| | 18 | 67 | 70 | ○ | ○ |
| | 22 | 68 | 70 | ○ | ○ |
| | 26 | 69 | 70 | ○ | ○ |
| | 30 | 70 | 70 | ○ | ○ |
| | 34 | 71 | 70 | ○ | ○ |
| | 38 | 72 | 70 | ○ | ○ |
| | 42 | 73 | 70 | ○ | ○ |
| | 46 | 74 | 70 | ○ | ○ |
| | 50 | 75 | 70 | X | ○ |

TABLE 2

| BASE MAT. OF BELT | HRD. (DEG) | HRD. WITH BELT (DEG) | PRESS. RLR HRD. (DEG) | CHAFF AT FIX. BELT | CHAFF AT PRESS. RLR |
|---|---|---|---|---|---|
| PI | 30 | 60 | 50 | X | ○ |
| | 30 | 60 | 52 | X | ○ |
| | 30 | 60 | 54 | X | ○ |
| | 30 | 60 | 56 | ○ | ○ |
| | 30 | 60 | 58 | ○ | ○ |
| | 30 | 60 | 60 | ○ | ○ |
| | 30 | 60 | 62 | ○ | ○ |
| | 30 | 60 | 64 | ○ | ○ |
| | 30 | 60 | 66 | ○ | ○ |
| | 30 | 60 | 68 | ○ | ○ |
| | 30 | 60 | 70 | ○ | X |
| SUS | 30 | 70 | 60 | X | ○ |
| | 30 | 70 | 62 | X | ○ |
| | 30 | 70 | 64 | X | ○ |
| | 30 | 70 | 66 | ○ | ○ |
| | 30 | 70 | 68 | ○ | ○ |
| | 30 | 70 | 70 | ○ | ○ |
| | 30 | 70 | 72 | ○ | ○ |

TABLE 2-continued

| BASE MAT. OF BELT | HRD. (DEG) | HRD. WITH BELT (DEG) | PRESS. RLR HRD. (DEG) | CHAFF AT FIX. BELT | CHAFF AT PRESS. RLR |
|---|---|---|---|---|---|
| | 30 | 70 | 74 | ○ | ○ |
| | 30 | 70 | 76 | ○ | ○ |
| | 30 | 70 | 78 | ○ | ○ |
| | 30 | 70 | 80 | ○ | X |

In Tables 1 and 2, "surface hardness of fixation roller inclusive of fixation belt" means the surface hardness of the fixation roller measured through the fixation belt 1 placed on the peripheral surface of the fixation roller. The hardness was measured with an Asker-C hardness meter. The evaluation symbol o means that the problems attributable to the scratches by the separation claws did not occur, and the evaluation symbol x means that the toner image T on the recording medium P was rubbed by the separation claws, and as a result, it became nonuniform in glossiness and/or streaky, or the toner image T was peeled away.

"Chaffing by Separation Claw on Fixation Belt Side" means the evaluation of the chaffing of the toner image T on the "first" side, that is, the fixation belt 1 side, of the recording medium P by the top separation claw 11, which occurred in the single-sided or two-sided print mode.

"Chaffing by Separation Claw on Pressure Roller Side" means the evaluation of the chaffing of the toner image T on the "first" side, that is, the pressure roller 4 side, of the recording medium P by the bottom separation claw 12, which occurred as the toner image having just been fixed to the recording medium P by being passed through the fixation nip N, was passed through the fixation nip N for the second time, in the manual or automatic two-sided mode.

In the case of these tests, the results of which are given in Table 1, the images formed using the fixation belt, the base layer of which was formed of resin (polyimide (PI)), and the fixation belt the base layer of which was formed of metallic substance (SUS), were evaluated in terms of the chaffing of the toner image attributable to the separation claws. The surface hardness of the pressure roller 4 was not changed, while the surface hardness of the fixation roller inclusive of the hardness or the fixation belt was varied by varying the surface hardness of the fixation roller 2.

1) According to the evaluation, in Table 1, of the results obtained using the fixation belt 1 the base layer of which is formed of PI, when the surface hardness of the fixation roller 2 was 30°; the surface hardness of the fixation roller 2 inclusive of the hardness of the fixation belt 1 was 60°; and the surface hardness of the pressure roller 4 was 60°, the chaffing of the toner image by the separation claws did not occur on either the fixation belt side or the pressure roller side, that is, the separation failure did not occur (condition A).

Also according to the evaluation, in Table 1, of the results obtained using the fixation belt 1 the base layer of which was formed of PI, as the surface hardness of the fixation roller 2, that is the surface hardness of the fixation roller 2 inclusive of the hardness of the fixation belt 1, was increased, the chaffing of the toner image by the separation claws on the fixation belt side gradually worsened: when the surface hardness of the fixation roller 2 was no less than 42°, that is, when the surface hardness of the fixation roller 2 inclusive of the hardness of the fixation belt 1 was no less than 66°, the evaluation of the chaffing of the toner image by the top separation claws was x. In comparison, the chaffing of the toner image by the separation claws on the pressure roller side gradually improved (reduced) as the surface hardness of the fixation roller 2, that is, the surface hardness of the fixation roller 2 inclusive of the hardness of the fixation belt 1, was increased (condition B).

Also according to the evaluation, in Table 1, of the results obtained using the fixation belt 1 the base layer of which is formed of PI, as the surface hardness of the fixation roller 2, that is, the surface hardness of the fixation roller 2 inclusive of the hardness of the fixation belt 1, was reduced, the chaffing of the toner image by the separation claws on the pressure roller side gradually worsened; when the surface hardness of the fixation roller 2 was no more than 10°, that is, when the surface hardness of the fixation roller 2 inclusive of the hardness of the fixation belt 1 was no more than 50°, the evaluation of the chaffing of the toner image by the bottom separation claws was x. In comparison, the chaffing of the toner image by the separation claws on the fixation roller side gradually improved (reduced) as the surface hardness of the fixation roller 2, that is, the surface hardness of the fixation roller 2 inclusive of the hardness of the fixation belt 1, was reduced (Condition C).

Figure 3:
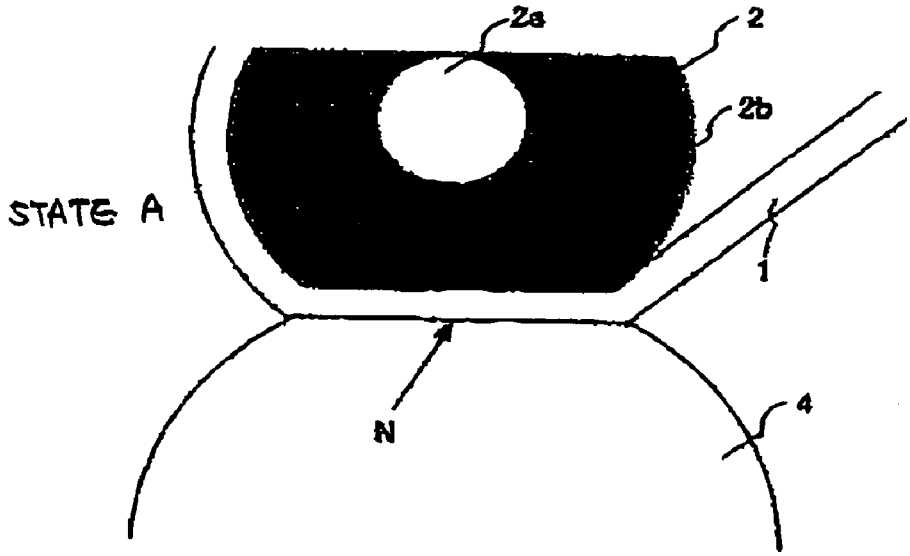
FIG. 3 is a schematic sectional view of the essential portion, that is, the nip portion, of the fixing apparatus in the first embodiment of the present invention, showing the cross sectional shape of the fixing nip.
Figure 4:
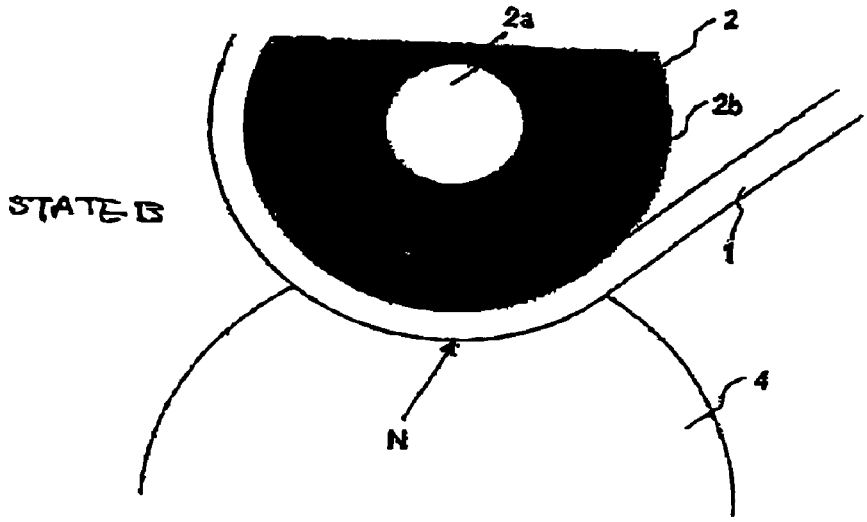
FIG. 4 is a schematic sectional view of the essential portion, that is, the nip portion, of a comparative fixing apparatus, showing the cross sectional shape of the fixing nip.
Figure 5:
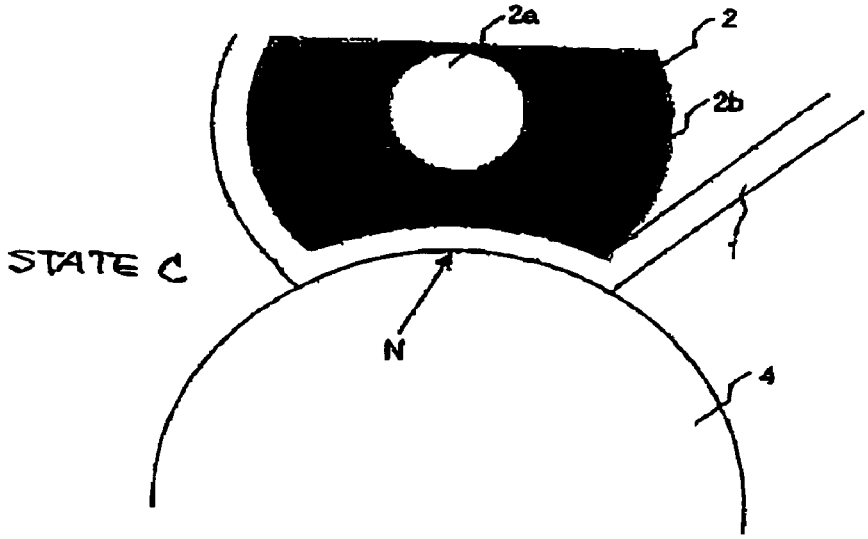
FIG. 5 is a schematic sectional view of the essential portion, that is, the nip portion, or another comparative fixing apparatus, showing the cross sectional shape of the fixing nip.

2) The principle of the above described phenomenon is shown in FIGS. 3, 4 and 5. FIGS. 3–5 are the sectional views or the fixation nip N, showing the shape of the cross section of the fixation nip N. For ease of description, the fixation nip N is exaggerated in size in all the drawings.

FIG. 3 shows the shape of the cross section of the fixation nip N when the fixing apparatus was under the aforementioned condition A. When the surface hardness of the fixation roller 2 is roughly equal to that of the pressure roller 4, the cross section of the fixation nip N becomes roughly straight as shown in FIG. 3. In this case, the recording medium P is discharged from the fixation nip N without following either fixation belt 1 or pressure roller 4 at the downstream end of the fixation nip N in terms of the recording medium conveyance direction; the rigidity of the recording medium P overcomes both the adhesion between the toner on the top surface of the recording medium P and the fixation belt 1, and the adhesion between the toner on the bottom surface of the recording medium P and the pressure roller 4, and therefore, the separation failure does not occur, making it possible to yield an image of good quality (clear image).

FIG. 4 shows the shape of the cross section of the fixation nip N when the fixing apparatus 101 is in the aforementioned condition B. When the surface hardness of the fixation roller 2 inclusive of the hardness of the fixation belt 1 is extremely high compared to that of the pressure roller 4, the cross section of the fixation nip N bows toward the pressure roller 4. In this case, as the recording medium P is discharged from the fixing apparatus, it is made to follow the fixation belt 1. Therefore, the rigidity of the recording medium P is overcome by the adhesion between the toner on the top surface of the recording medium P and the fixation belt 1, allowing the separation failure to occur. Therefore, the toner image T on the top surface of the recording medium P is chaffed by the top separation claws 11, creating such problems that it becoming nonuniform in glossiness, becomes streaky, and/or is peeled way from the recording medium P.

FIG. 5 shows the shape of the cross section of the fixation nip N when the fixing apparatus 101 is in the aforementioned condition C. When the surface hardness of the fixation roller 2 inclusive of the hardness of the fixation belt 1 is extremely low compared to that of the pressure roller 4, the cross section of the fixation nip N bows toward the fixation roller 2. Thus, as the recording medium P is discharged from the fixing apparatus, it is made to follow the pressure roller 2. Therefore, the rigidity of the recording medium P is overcome by the adhesion between the toner on the bottom surface of the recording medium P and the pressure roller 4, allowing the separation failure to occur. Therefore, the toner image T on the bottom surface of the recording medium P is chaffed by the bottom separation claws 12, creating such problems that it becoming nonuniform in glossiness, becomes streaky, and/or is peeled way from the recording medium P.

3) Referring to Table 1, according to the evaluation of the results from the usage of the fixation belt 1 the base layer of which was formed of SUS, when the surface hardness of the fixation roller 2 is 30°; the surface hardness of the fixation roller 2 inclusive of the hardness of the fixation belt 1 is 70°; and the surface hardness of the pressure roller 4 is 70°, the separation failure did not occur, rendering the evaluation o, and therefore, the chaffing of the toner image T by the separation claws 11 or 12 did not occur on either fixation belt or pressure roller side (condition A).

Also according to the evaluation of the results from the usage of the fixation belt 1 the base layer of which was formed of SUS, as the surface hardness of the fixation roller 2, that is, the surface hardness of the fixation roller 2 inclusive of the hardness of the fixation belt 1, was increased, the chaffing of the toner image T by the separation claws on the fixation belt side gradually worsened; when the surface hardness of the fixation roller 2 was no less than 50°, that is, when the surface hardness of the fixation roller 2 inclusive of the hardness of the fixation belt 1 was no less than 70°, the toner image T was chaffed by the top separation claws 11, rendering the evaluation x. On the contrary, the chaffing of the toner image T by the separation claws 12 on the pressure roller side gradually improved (reduced) as the surface hardness of the fixation roller 2, that is, the surface hardness of the fixation roller 2 inclusive of the hardness of the fixation belt 1, was increased (condition B).

Also according to the evaluation, in Table 1, of the results obtained using the fixation belt 1 the base layer of which is formed of SUS, as the surface hardness of the fixation roller 2, that is, the surface hardness of the fixation roller 2 inclusive of the hardness of the fixation belt 1, was reduced, the chaffing of the toner image by the separation claws 11 on the pressure roller side gradually worsened. However, even after the surface hardness of the fixation roller 2 was reduced to as low as 10°, the chaffing of the toner image T by the separation claws 12 on the pressure roller side did not occur, because the surface hardness of the fixation roller 2 inclusive of the hardness of the fixation belt 1 did not reduce below 65°.

The principle of the occurrences of the above described phenomena is also the same as those shown in FIGS. 3 (condition A) and 4 (condition B).

4) Table 2 gives the results of the experiments carried out to test the aforementioned two types of fixation belts 1: the fixing belt having the polyimide (PI) base layer, and the fixing belt having the SUS base layer, in terms of the chaffing of the toner image by the separation claws, while varying the surface hardness of the fixation roller 2 and pressure roller 4, with the surface hardness of the fixation roller 2 alone, and the surface hardness of the fixation roller 2 inclusive of the hardness of the fixation belt 1, kept constant.

According to the evaluation, in Table 2, of the results obtained using the fixation belt 1 the base layer of which is formed of polyimide (PI), when the surface hardness of the fixation roller 2 was 30°; the surface hardness of the fixation roller 2 inclusive of the hardness of the fixation belt 1 was 60°; and the surface hardness of the pressure roller 4 was 60°, the evaluation was o. In other words, the separation failure did not occur, and therefore, the chaffing of the toner image by the separation claws did not occur on either the fixation belt side or the pressure roller side (condition A).

Also according to the evaluation, in Table 2, of the results obtained using the fixation belt 1 the base layer of which is formed of PI, as the surface hardness of the pressure roller 4 was increased, the chaffing of the toner image by the separation claws on the fixation belt side gradually worsened; when the surface hardness of the pressure roller 4 was no more than 54°, the toner image on the recording image was chaffed by the top separation claws 11. In other words, the evaluation was x. In comparison, the chaffing of the toner image by the separation claws on the pressure roller side gradually improved (reduced) as the surface hardness of the pressure roller 4 was reduced (condition B).

Also according to the evaluation, in Table 2, of the results obtained using the fixation belt 1 the base layer of which is formed of PI, as the surface hardness of the pressure roller 4 was increased, the chaffing of the toner image by the separation claws on the pressure roller side gradually worsened; when the surface hardness of the pressure roller 4 was no less than 70°, the toner image was chaffed by the bottom separation claws 12. In other words, the evaluation was x. In comparison, the chaffing of the toner image by the separation claws on the fixation roller side gradually improved (reduced) as the surface hardness of the pressure roller 4 was increased (Condition C).

The principles of these phenomena are also the same as those shown in FIGS. 3 (condition A), 4 (condition B) and 5 (condition C).

5) Referring to Table 2, according to the evaluation of the results from the usage of the fixation belt 1 the base layer of which was formed of SUS, when the surface hardness of the fixation roller 2 was 30°; the surface hardness of the fixation roller 2 inclusive of the hardness of the fixation belt 1 was 70°; and the surface hardness of the pressure roller 4 was 70°, the separation failure did not occur, and therefore, the chaffing of the toner image T by the separation claws 11 or 12 did not occur on either the fixation belt or pressure roller side. In other words, the evaluation was o (condition A).

Also according to the evaluation of the results from the usage of the fixation belt 1 the base layer of which was formed of SUS, as the surface hardness of the pressure roller 4 was reduced, the chaffing of the toner image T by the separation claws on the fixation belt side gradually worsened; when the surface hardness of the pressure roller 4 was no more than 64°, the toner image T was chaffed by the top separation claws 11. In other words, the evaluation was x. On the contrary, the chaffing of the toner image T by the separation claws 12 on the pressure roller side gradually improved (reduced) as the surface hardness of the pressure roller 4 was reduced (condition B).

Also according to the evaluation, in Table 2, of the results obtained using the fixation belt 1 the base layer of which is formed of SUS, as the surface hardness of the pressure roller 4 was increased, the chaffing of the toner image by the separation claws 12 on the pressure roller side gradually worsened; when the surface hardness of the pressure roller 4 was no less than 80°, the toner image was chaffed by the bottom separation claws 12. In other words, the evaluation was x. On the contrary, the chaffing of the toner image on the fixation roller side gradually improved (reduced) as the surface hardness of the pressure roller 4 was increased (condition C).

The principles of the occurrences of these phenomena are also the same as those shown in FIGS. 3 (condition A), 4 (condition B), and 5 (condition C).

The examination of Tables 1 and 2 reveals that the separation failure between the toner images T on the top and bottom surfaces, one for one, of the recording medium P from the fixation belt 1 and pressure roller 4, respectively, does not depend on the surface hardness of the fixation roller 2 alone, but on the relationship between the "surface hardness of the fixation roller inclusive of the hardness of the fixation roller", that is, the surface hardness of the fixation roller 2 measured through the fixation belt 1 on the fixation roller 2, and the surface hardness of the pressure roller 4.

Generally, the base layer of the fixation belt 1 is formed of resin or metal. Thus, the surface hardness of the fixation roller 2 inclusive of the hardness of the fixation belt 1 is greater than that of the fixation roller 2 alone, whether the fixation roller 2 is reduced in surface hardness or not. Further, the surface hardness of the fixation roller 2 inclusive of the hardness of the fixation belt 1 is substantially affected by the hardness of the base layer or the fixation belt 1. Thus, it is greater when the base layer is formed of metal than when the base layer is formed of resin, even if the two base layers are the same in thickness. Obviously, the surface hardness of the fixation roller 2 inclusive of the hardness of the fixation belt 1 also depends on the thickness and hardness of the elastic layer of the fixation belt 1, and the thickness and hardness of the release layer. In addition to the thickness of the base layer or the belt 1 and the material therefor. Thus, in order to prevent the separation failure, it is necessary to optimize the relationship between the surface hardness or the combination of the fixation belt 1 and fixation roller 2, that is, the surface hardness of the fixation roller 2 inclusive of the hardness of the fixation belt 1, and the surface hardness of the pressure roller 4, instead of simply optimizing the surface hardness of the fixation roller 2.

As was described with reference to FIGS. 3, 4 and 5, the chaffing by the separation claws on the fixation belt side (chaffing of toner image T by top separation claws 11) gradually worsens as the surface hardness of the fixation roller 2 inclusive of the hardness of the fixation belt 1 exceeds the surface hardness of the pressure roller 4, and improves (reduces) as it falls below the surface hardness of the pressure roller 4. On the contrary, the chaffing by the separation claws on the pressure roller side (chaffing of toner image T by bottom separation claws 12) gradually improves (reduces) as the surface hardness of fixation roller 2 increases past the surface hardness of the pressure roller 4, whereas it gradually worsens as the surface hardness of fixation roller 2 inclusive of the hardness or the fixation belt 1 decreases past the surface hardness of the pressure roller 4.

In other words, the gist of this embodiment of the present invention is to regulate the relationship between the surface hardness of the fixation 2 inclusive of the hardness of the fixation belt 1, and the surface hardness of the pressure roller 4. In order to give the cross section of the fixation nip N the shape shown in FIG. 3 to prevent the separation failure.

More specifically, the shape of the cross section of the fixation nip N can be made to be as shown in FIG. 3 by manufacturing the fixation belt 1, fixation roller 2, and pressure roller 4 so that the surface hardness of the fixation roller 2 measured through the fixation belt 1 on the fixation roller 2, that is, the surface hardness of the fixation roller 2 inclusive of the hardness of the fixation belt 1, falls within the range of (surface hardness of the pressure roller 4 −8°)–(surface hardness of the pressure roller 4 +4°) (measured by Asker-C scale hardness meter). With the cross section or the fixation nip N being in the shape shown in FIG. 3, the toner images T on the top and bottom surfaces of the recording medium P do not fall to separate from the fixation belt 1 and pressure roller 4, respectively. Therefore, the toner images T are not chaffed by the separation claws 11 and 12. Therefore, the toner images T are neither rendered nonuniform in glossiness, nor streaky, and are not peeled away, making it possible to yield high quality images (clear images).

Regarding the optimum range for the surface hardness of the fixation roller 2 inclusive of the hardness of the fixation belt 1 for preventing the separation failure, its negative side, relative to the surface hardness of the pressure roller 4, is greater than its positive side, because the adhesion between the fixation belt 1 and toner image T is greater than the adhesion between the pressure roller 4 and toner image T. More specifically, the fixation belt J must melt the unfixed toner image T to fix it to the recording medium P. Therefore, it must be heated to a higher temperature (180° C. in this embodiment) than the pressure roller 4. Therefore, the adhesion between the fixation belt 1 and toner image T becomes stronger than the adhesion between the pressure roller 4 and toner image T.

In addition, in the automatic two-sided print mode, for example, the pressure roller 4 is robbed of heat (cooled) by the recording medium P while the toner image T on the first surface is fixed. Also in the two-sided print mode, the toner image having already been fixed to the recording medium P is passed through the fixation nip N. Thus, in order to render the top and bottom surfaces of the recording medium as close as possible to each other in glossiness or the like, the temperature of the pressure roller 4 is set to a level (roughly 100° C. in this embodiment) substantially lower than the level to which the temperature of the fixation belt 1 is set, in an attempt to minimize the amount by which the fixed toner image T on the pressure roller side is melted. In other words, the adhesion between the pressure roller 4 and toner image T occurs when the amount by which the toner image T is melted is smaller. Therefore, the adhesion between the pressure roller 4 and toner image T is weaker. Therefore, in the two-sided print mode, the shape of the cross section of the fixation nip N is desired to be slightly bowed toward the fixation roller 2, instead of being straight, in order to make it easier for the fixation belt 1 to release the toner image T.

The surface hardness of the fixation roller 2, surface hardness of the fixation roller 2 inclusive of the hardness of the fixation belt 1, and surface hardness of the pressure roller 4 do not need to have the above described numerical values. They may be optionally set in consideration of the structures of the fixing apparatus and image forming apparatus, as long as the difference between the surface hardness of the fixation roller 2 inclusive of the hardness of the fixation belt 1 and the surface hardness of the pressure roller 4 falls within the aforementioned range of (surface hardness of the pressure roller 4 −8°)–(surface hardness of the pressure roller 4 +4°).

Generally, the base layer of the fixation belt 1 is formed of resin or metal. Thus, the surface hardness of the fixation roller 2 inclusive of the hardness of the fixation belt 1 is greater than that of the fixation roller Z alone, whether the fixation roller 2 is reduced in surface hardness or not. Thus, in order to make the difference between the surface hardness of the fixation roller 2 inclusive of the hardness of the fixation belt 1 fall within the aforementioned range or (surface hardness of the pressure roller 4 −8°)–(surface hardness of the pressure roller 4 +4°), it is necessary to satisfy the following requirement: surface hardness of the fixation roller 2<surface hardness of the pressure roller 4. Further, the surface hardness of the fixation belt 1 is greater than those of the fixation roller 2 and pressure roller 4.

In order to strengthen the adhesion between the recording medium P and toner particles (in order to better fix toner image), it is desired to increase the amount by which heat is given to the recording medium P from the fixation belt 1 and pressure roller 4 in the fixation nip N, and therefore, the greater the width of the fixation nip N, the better. In order to increase the width of the fixation nip N, the surface hardness of the fixation roller 2 is desired to be as small as possible; it is preferred to be no more than 60°. (Asker-C scale hardness meter). However, the fixation roller 2 is rotated by the circular movement of the fixation belt 1 because of the presence of the friction between the peripheral surface of the fixation roller 2 and the internal surface of the fixation belt 1. Therefore, the fixation roller 2 is required to have a certain degree of firmness: the surface hardness of the fixation roller 2 is desired to be no less than 10° (Asker-C scale hardness meter).

It is a well-known fact that the lower the surface hardness of the fixation roller 2, in other words, the greater the width of the fixation nip N, the greater the effect of the shape of the cross section of the fixation nip N upon the separation of the toner image on the recording medium P from the fixation belt 1 or the pressure roller 4. Therefore, the greater the width of the fixation nip N, the greater the effect of the application of the present invention.

In order to increase the speed at which the fixation belt 1 is started up to a predetermined temperature, it is desired to minimize the amount of the heat robbed from the fixation belt 1 by the fixation roller 2. Thus, the fixation belt 1 of a fixing apparatus such as the fixing apparatus 101 in this embodiment, the fixation roller 2 of which does not have an internal heater, is desired to be thermally insulated. Therefore, the thermal conductivity of the heat resistant elastic layer **2*b* of the fixation roller 2 is desired to be as small as possible; it is desired to be no more than 0.16 [W/m·° C.]. As another means for enhancing the insulative properties of the heat resistant elastic layer 2*b*, the heat resistant elastic layer 2*b*** is desired to be formed of spongy rubber, which is filled with air layers (bubbles), being therefore highly effective in thermal insulation, instead of solid rubber.

The separation failure is likely to worsen as the amount (per unit of area) by which toner is deposited on the recording medium P increases. Thus, the effect of the application of this embodiment of the present invention is greater in the full-color print mode than in the monochromatic mode, because the amount by which toner is deposited on the recording medium P is greater in the full-color mode than in the monochromatic mode.

This embodiment of the present invention was realized in consideration of not only the one-sided print mode, but also the two-sided print mode. Thus, not only is it applicable to a fixing apparatus for an image forming apparatus capable of printing on only one side of the recording medium P, but also a fixing apparatus for an image forming apparatus capable of automatically printing on both sides of the recording medium P. Obviously, however, the effect of the application of this embodiment is greater when this embodiment is applied to the latter.

This embodiment was described with reference to the oil-free fixing apparatus, in which the fixation belt 1 and pressure roller 4 were provided with a release layer, as the outermost layer, formed of fluorinated resin or the like. However, the above described effects can also be obtained when this embodiment is applied to an oil coating type fixing apparatus, the surface layers of the fixation belt 1 and pressure roller 4 of which are plain heat resistant elastic layers formed of silicone rubber or the like, and which is provided with an oil coating apparatus for coating the fixation belt 1 or pressure roller 4 with oil.

(Embodiment 2)

Next, referring to FIGS. 6 and 7, and Tables 3 and 4, the second embodiment of the present invention will be described.

In the fixing apparatus 101 in the above described first embodiment, the contact type separation claws 11 and 12 were positioned in contact with fixation belt 1 and pressure roller 4, respectively, on the downstream side of the fixation nip N, in terms of the recording medium conveyance direction. However, the present invention is also applicable to a fixing apparatus which does not have the contact type separation claws.

Next, the present invention for preventing the recording medium from wrapping around the fixation belt or pressure roller, by preventing the separation failure, will be described with reference to the fixing apparatus in this embodiment which does not have the contact type separation claws.

Figure 6:
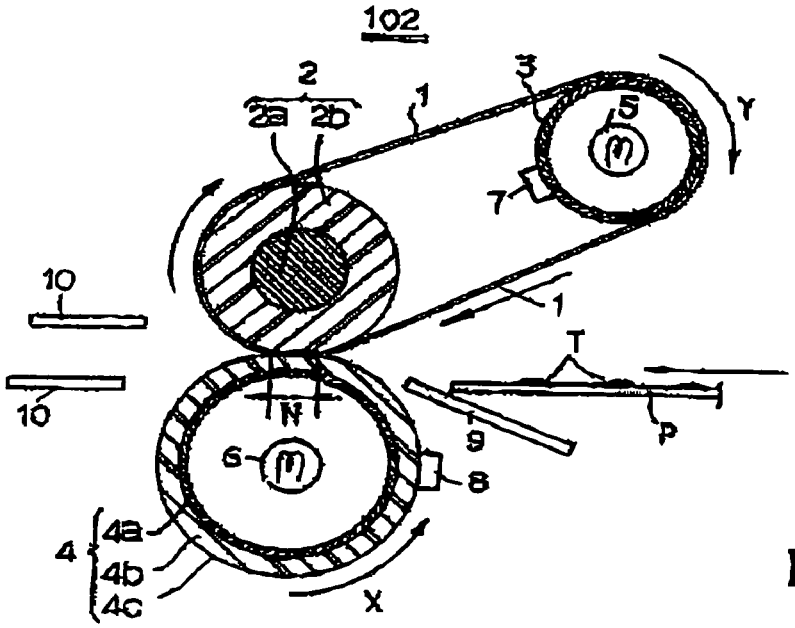
FIG. 6 is a schematic sectional view of the fixing apparatus in the second embodiment of the present invention, showing the general structure thereof.

FIG. 6 shows the fixing apparatus 102 in this embodiment, which is different from the fixing apparatus 101 shown in FIG. 2 in that it does not have the top and bottom separation claws 11 and 12 as contact separation claws which the fixing apparatus 101 has. Otherwise, the two fixing apparatus are the same in structure.

The fixing apparatus 102 in this embodiment, shown in FIG. 6, which did not have the separation claws which the fixing apparatus 101 in the first embodiment, shown in FIG. 2, had, was evaluated through the same tests as those to which the fixing apparatus 101 was subjected.

The results are given in Tables 3 and 4, which arc different from Tables 1 and 2 in that, in Tables 3 and 4, the evaluation items or "chaffing by separation claws on fixation belt side" and "chaffing by separation claws on pressure roller side" in Tables 1 and 2 have been replaced with "separation on fixation belt side" and "separation on pressure roller side". When the recording medium P wrapped around the fixation belt 1 or pressure roller 4, and therefore, failed to be conveyed to the sheet discharge guides 10, the separation was evaluated as x, and when the recording medium P was smoothly conveyed to the sheet discharge guides 10, the separation was evaluated as o.

TABLE 3

| BASE MAT. OF BELT | HRD. (DEG) | HRD. WITH BELT (DEG) | PRESS. RLR HRD. (DEG) | SEP. PERFOR-MANCE | SEP. PERFORMANCE |
|---|---|---|---|---|---|
| PI | 10 | 50 | 60 | ○ | X |
| | 14 | 52 | 60 | ○ | ○ |
| | 18 | 54 | 60 | ○ | ○ |
| | 22 | 56 | 60 | ○ | ○ |
| | 26 | 58 | 60 | ○ | ○ |
| | 30 | 60 | 60 | ○ | ○ |
| | 34 | 62 | 60 | ○ | ○ |
| | 38 | 64 | 60 | ○ | ○ |
| | 42 | 66 | 60 | X | ○ |
| | 46 | 68 | 60 | X | ○ |
| | 50 | 70 | 60 | X | ○ |

TABLE 3-continued

| BASE MAT. OF BELT | HRD. (DEG) | HRD. WITH BELT (DEG) | PRESS. RLR HRD. (DEG) | SEP. PERFOR-MANCE | SEP. PERFORMANCE |
|---|---|---|---|---|---|
| SUS | 10 | 65 | 70 | ○ | ○ |
| | 14 | 66 | 70 | ○ | ○ |
| | 18 | 67 | 70 | ○ | ○ |
| | 22 | 68 | 70 | ○ | ○ |
| | 26 | 69 | 70 | ○ | ○ |
| | 30 | 70 | 70 | ○ | ○ |
| | 34 | 71 | 70 | ○ | ○ |
| | 38 | 72 | 70 | ○ | ○ |
| | 42 | 73 | 70 | ○ | ○ |
| | 46 | 74 | 70 | ○ | ○ |
| | 50 | 75 | 70 | X | ○ |

TABLE 4

| BASE MAT. OF BELT | HRD. (DEG) | HRD. WITH BELT (DEG) | PRESS. RLR HRD. (DEG) | SEP. PERFOR-MANCE | SEP. PERFORMANCE |
|---|---|---|---|---|---|
| PI | 30 | 60 | 50 | X | ○ |
| | 30 | 60 | 52 | X | ○ |
| | 30 | 60 | 54 | X | ○ |
| | 30 | 60 | 56 | ○ | ○ |
| | 30 | 60 | 58 | ○ | ○ |
| | 30 | 60 | 60 | ○ | ○ |
| | 30 | 60 | 62 | ○ | ○ |
| | 30 | 60 | 64 | ○ | ○ |
| | 30 | 60 | 66 | ○ | ○ |
| | 30 | 60 | 68 | ○ | ○ |
| | 30 | 60 | 70 | ○ | X |
| SUS | 30 | 70 | 60 | X | ○ |
| | 30 | 70 | 62 | X | ○ |
| | 30 | 70 | 64 | X | ○ |
| | 30 | 70 | 66 | ○ | ○ |
| | 30 | 70 | 68 | ○ | ○ |
| | 30 | 70 | 70 | ○ | ○ |
| | 30 | 70 | 72 | ○ | ○ |
| | 30 | 70 | 74 | ○ | ○ |
| | 30 | 70 | 76 | ○ | ○ |
| | 30 | 70 | 78 | ○ | ○ |
| | 30 | 70 | 80 | ○ | X |

The evaluations, given in Tables 3 and 4, for the fixing apparatus 102 in this embodiment are the same as those, given in Tables 1 and 2, for the fixing apparatus 101 in the first embodiment. More specifically. The shape of the cross section of the fixation nip N was made to be virtually straight as shown in FIG. 3 by manufacturing the fixation belt 1, fixation roller 2, and pressure roller 4 so that the surface hardness of the fixation roller 2 measured through the fixation belt 1 on the fixation roller 2, that is, "surface hardness of the fixation roller 2 inclusive of the hardness of the fixation belt 1", fell within the range of (surface hardness of the pressure roller 4 −8°)–(surface hardness of the pressure roller 4 +4°) (measured by Asker-C scale hardness meter). With the cross section of the fixation nip N being in the shape shown in FIG. 3, the toner images T on the top and bottom surfaces of the recording medium P did not fail to separate from the fixation belt 1 and pressure roller 41 respectively, being thereby prevented from wrapping around the fixation belt 1 or pressure roller 4. In other words, the contact type separation claws were unnecessary to prevent the separation failure. The principles behind these phenomena are the same as those described regarding the chaffing of the toner image T by the separation claws with reference to FIGS. 3, 4, and 5.

As will be evident from the above description, the present invention makes it possible to eliminate the contact separation claws in order to prevent the problems attributable to the shaving of the fixation belt 1 and/or pressure roller 4 by the contact separation claws, for example, the problem that an image having streaks, parallel to the recording medium conveyance direction, resulting from the shaving of the fixation belt 1 and/or pressure roller 4 by the contact separation claws is produced, the problem that the streaky portions or the image fail to be properly fixed, the problem that the release layers of the fixation belt 1 and pressure roller 4 are shaved, allowing thereby toner particles to remain adhered to the fixation belt 1 and pressure roller 4 (allowing toner particles to contaminate fixation belt 1 and pressure roller 4), and the like problems. In other words, the present invention makes it possible to strengthen the service lives of the fixation belt 1 and pressure roller 4, lengthening thereby the service life of a fixing apparatus. Therefore, the present invention can reduce the operational cost or an image forming apparatus.

This embodiment was described with reference to the oil-free fixing apparatus, the fixation belt 1 and pressure roller 4 of which were provided with the release layer as a surface layer, and which used such toner that internally contained oil. In an oil-free fixing apparatus, oil was not present between the fixation belt 1 and contact separation claws, and between the pressure roller 4 and contact separation claws, being therefore greater in the friction coefficients between the fixation belt 1 and contact separation claws, and between the pressure roller 4 and contact separation claws, compared to those in a fixing apparatus equipped with an oil coating apparatus. Therefore, the oil-free fixing apparatus is greater in the chaffing of the fixation belt 1 and pressure roller 4 by the contact separation claws than the fixing apparatus equipped with an oil coating apparatus.

Therefore, the effect of eliminating the contact separation claws by applying the present invention to a fixing apparatus is greater when the present invention is applied to an oil-free fixing apparatus than when it is applied to a fixing apparatus with an oil coating apparatus.

In the above described experiments carried out to test this embodiment, the leading end margin (distance from leading edge of recording medium P to leading end of toner image T) was 2 mm. However, in the case of the fixing apparatus 102 in this embodiment shown in FIG. 6, the problem that the recording medium P fails to separate from the fixation belt 1 or pressure roller 4 and wraps around the fixation belt 1 or pressure roller 4 sometimes occurs, when the leading end margin is 0 mm. The problem rarely occurs; it occurs only when an image forming apparatus is malfunctioning. The reason for this problem is that the smaller the leading end margin, the more difficult it is for the toner image T (recording medium P) from separating from the fixation belt 1 or pressure roller 4.

Figure 7:
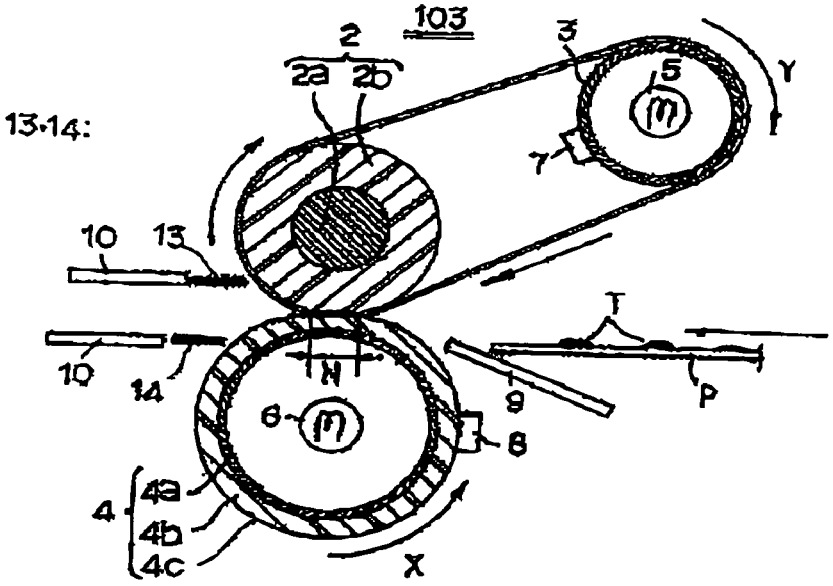
FIG. 7 is a schematic sectional view of a modified version of the fixing apparatus in the second embodiment of the present invention, showing the general structure thereof.

In order to prevent the above described problem which occurs only when the leading end margin is 0 mm or virtually 0 mm, a fixing apparatus is desired to be designed like the fixing apparatus 103 shown in FIG. 7, which is provided with noncontact members for preventing the recording medium P from wrapping around the fixation belt 1 or pressure roller 4 even if the leading end margin is 0, or virtually 0 mm. To describe the fixing apparatus 103 in more detail, it comprises a top noncontact separation plate 13 and a bottom noncontact separation plate 14, which are disposed on the downstream side of the fixation nip N, immediately next to the peripheral surfaces of the fixation belt 1 and pressure roller 4, respectively, without being placed in contact therewith. Although it depends on the structures of a fixing apparatus and/or an image forming apparatus, the fixing apparatus may be provided with either one of the top and bottom noncontact separation plates 13 and 14, or both.

The distances between the noncontact separation plates 13 and 14, and the fixation belt 1 and pressure roller 4, respectively, vary because of manufacturing errors and the thermal expansion of the elastic layers of the fixation belt 1 and pressure roller 4. Thus, if the distances are too small, the noncontact separation plates 13 and 14 are likely to come into contact with the fixation belt 1 and pressure roller 4, being thereby shaved by the plates 13 and 14, respectively. Therefore, the distances are desired to be such that even when the fixation belt 1 and pressure roller 4 are hot enough for fixation, there will be a distance of no less than 50 $\mu$m between the noncontact separation plates 13 and 14, and the fixation belt 1 and pressure roller 4, respectively. On the other hand, if the distances are too large, the noncontact separation plates 13 and 14 fail to separate the recording medium P from the fixation belt 1 and pressure roller 4, respectively. Therefore, the distances are desired to be such that even when the fixation belt 1 and pressure roller 4 are hot enough for proper fixation, the distances will be no more than 500 $\mu$m.

When the fixing apparatus 103 in this embodiment in which the surface hardness of the fixation roller 2 measured through the fixation belt 1 on the fixation roller 2, that is, "surface hardness of the fixation roller 2 inclusive or the hardness of the fixation belt 1", fell within the range of (surface hardness of the pressure roller 4 −8°)–(surface hardness of the pressure roller 4 +4°) (measured by Asker-C scale hardness meter), and also, in which the distances between the top noncontact separation plate 13 and fixation belt 1, and the distance between the bottom noncontact separation plate 14 and pressure roller, were set so that when the fixing apparatus was ready for fixation, the distances became 300 $\mu$m, was tested, the recording medium P did not wrap around the fixation belt 1 or pressure roller 4, even when the leading end margin became 0 mm due to the malfunction or the like or the image forming apparatus.

(Embodiment 3)

Figure 8:
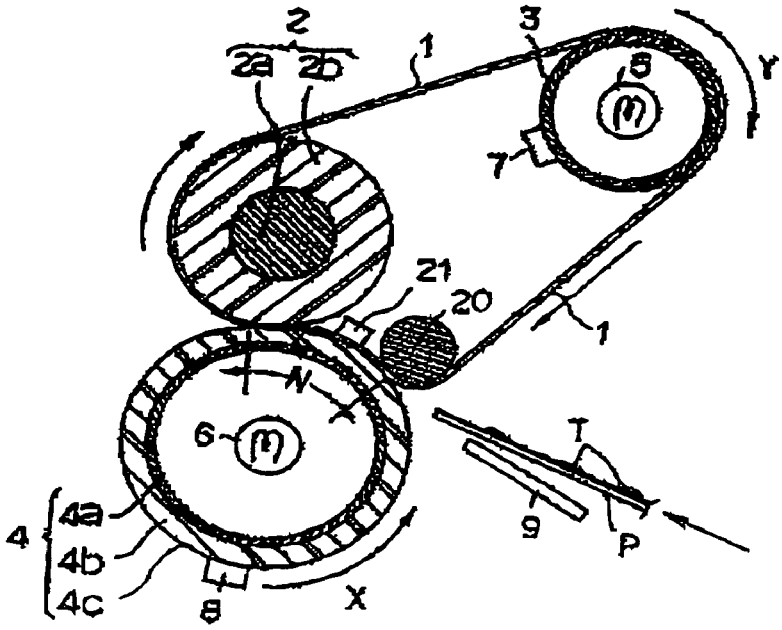
FIG. 8 is a schematic sectional view of the fixing apparatus in the third embodiment of the present invention, showing the general structure thereof.
Figure 9:
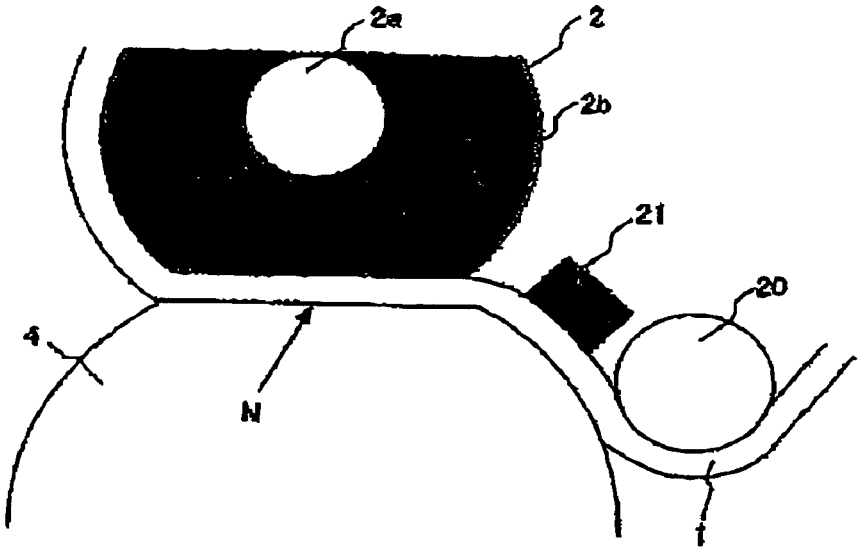
FIG. 9 is a schematic sectional view of the essential portion, that is, the nip portion, of the fixing apparatus in the third embodiment of the present invention, showing the cross sectional shape of the fixing nip.

Referring to FIGS. 8 and 9, the third embodiment of the present invention will be described.

In the above described first and second embodiments, the fixation belt 1 of the fixing apparatus was stretched around (suspended by) two shafts: fixation roller 2 and heat roller 3. The present invention, however, is also applicable to a fixing apparatus such as the one shown in FIG. 8; the fixation belt 1 is stretched around (suspended by) three shafts, that 1 is the fixation roller 2, the heat roller 3, and an auxiliary fixation roller 20, in order to widen the fixation nip N to increase the amount by which heat is applied to the recording medium P as well as toner image T. In other words, this embodiment is an example of the application of the present invention to a fixing apparatus, the fixation belt 1 or which is suspended by three shafts.

Referring to FIG. 8, in this embodiment, the fixing apparatus is provided with the auxiliary fixation roller 20, in addition to the fixation roller 2 and pressure roller 4, by which the fixation belt 1 is suspended. The auxiliary fixation roller 20 is positioned upstream of the fixation roller 2 in terms of the recording medium conveyance direction, being pressed against the pressure roller 4 with the application of a predetermined amount of pressure in order to widen the fixation nip N. With the fixation nip N widened, the length of the time the recording medium P and toner image T are heated in the fixation nip N is longer. Therefore, the toner image T is better fixed to the recording medium P. FIG. 9 is an enlarged schematic sectional view of the fixation nip N and its adjacencies, showing the shape of the cross section of the fixation nip N.

Although it depends on the structure of a fixing apparatus, the auxiliary fixation roller 20 may be positioned so that the auxiliary fixation roller 20 increases the width of the fixation nip N by partially wrapping the fixation belt 1 around the pressure roller 4, without being pressed against the pressure roller 4.

The auxiliary fixation roller 20 may be a plain metallic roller formed of aluminum, iron, or the like, or a multilayer roller comprising a metallic base roller, and a heat resistant elastic layer coated on the peripheral surface of the base roller. The auxiliary fixation roller 20 in this embodiment is a multilayer roller with an overall external diameter or 14 mm, and comprises a metallic roller (iron roller) with an external diameter of 10 mm, and a 2 mm thick silicone sponge layer coated on the peripheral surface of the iron roller. The silicone sponge layer is 50° in surface hardness (Asker-C scale), and 0.08 [W/m·° C.] in thermal conductivity.

In order to make the pressure in the fixation nip N shown in FIG. 8 uniform in terms of the direction perpendicular to the recording medium conveyance direction, it is recommendable to place a pressing member 21 between the fixation roller 2 and auxiliary fixation roller 20.

When the fixing apparatus in this embodiment, in which the shape of the cross section of the downstream side of the fixation nip N was made virtually straight as shown in FIG. 9, by designing the fixing apparatus so that the surface hardness of the fixation roller 2 measured through the fixation belt 1 on the fixation roller 2, that is, "surface hardness of the fixation roller 2 inclusive of the hardness or the fixation belt 1", fell within the range of (surface hardness or the pressure roller 4 −8°)–(surface hardness of the pressure roller 4 +4°) (measured by Asker-C scale hardness meter), was subjected to the same tests as those to which the fixing apparatuses in the first and second embodiments were subjected, the toner images T on the top and bottom surfaces or the recording medium P did not fail to separate from the fixation belt 1 and pressure roller 4, respectively. This occurred for the following reason. That is, the portion of the fixation nip N, which affects the separation of the toner image T from the fixation belt 1 or pressure roller 4 is the downstream portion of the fixation nip N. In other words, the separation of the toner image on the recording medium P from the fixation belt 1 or pressure roller 4 is overwhelmingly affected by the downstream portion, that is, the exit side, of the fixing nip N; it is not affected by the upstream portion of the fixation nip N. Thus, even if the cross section of the upstream side of the fixation nip N of the fixing apparatus in this embodiment bows away from the pressure roller 4 as shown in FIG. 9, the same effects as those obtained by the fixing apparatuses in the first and second embodiments can be obtained by the fixing apparatus in this embodiment, because the cross section of the downstream portion of the fixation nip N of the fixing apparatus in this embodiment is virtually straight.

Therefore, even if the fixing apparatus in this embodiment is provided with the contact separation claws, the chaffing of the toner image on the recording medium P by the contact separation claws is prevented. Therefore, an inferior image, for example, an image which is not uniform in glossiness, an image which is streaky. Or the like, is not formed, and also, the toner image is not peeled away from the recording medium.

When the fixing apparatus in this embodiment does not have the contact separation claws, this embodiment can prevent the recording medium P from wrapping around the fixation belt 1 or pressure roller 4, making it possible to provide a highly durable fixing apparatus which does not reduce a toner image in quality, and an image forming apparatus lower in operational cost.

(Miscellanies)

1) The various numerical values in the above described embodiments of the present invention are nothing but examples for simplifying the descriptions of the embodiments. They may be changed in consideration of the structures and settings of a fixing apparatus and an image forming apparatus.

2) The application of the present invention does not need to be limited to such a fixing apparatus as the fixing apparatuses in the first to third embodiments; the present invention can also be applied to fixing apparatuses other than those in the first to third embodiments.

3) The application of the present invention does not need to be limited to a fixing apparatus, the flexible movable member, that is, the fixing belt 1, of which is in the endless form as in the above described embodiments. For example, the present invention is also applicable to a fixing apparatus, the flexible movable member of which is a roll of a long strip of film or the like, which is movable from one end or the fixation nip N to the other by rolling it out from a rollout shaft and rolling it up by a take-up shaft.

4) The present invention is also applicable to a fixing apparatus, the flexible movable member, that is, the fixating belt 1, of which is heated by an optional internal or external heating means other than the heat rollers 3 in the preceding embodiments. For example, the present invention is applicable to a fixing apparatus, the fixation belt 1 of which is provided with an electromagnetic heat induction layer so that heat can be directly induced in the fixation belt 1 by subjecting the fixation belt 1 to an alternating magnetic field.

5) The present invention is applicable to a fixing apparatus provided with a solidly attached nonrotational member, as the backup member for the fixation belt 1, on which the fixation belt 1 is smoothly slidable, with the inward surface of the fixation belt 1 being in contact therewith, instead of the fixation roller 2 as the backup member for the fixation belt 1.

6) The present invention is applicable to a fixing apparatus, the rotational elastic pressure applying member of which is a circularly movable belt, instead of the pressure roller 4.

7) Obviously, not only is an image heating apparatus in accordance with the present invention is effective as a fixing apparatus like the fixing apparatuses in the preceding embodiments, but also, effective as an apparatus for temporarily fixing an unfixed image to recording medium, an apparatus for improving, in surface properties, a recording medium having a fixed image, or the like apparatuses.

8) In the preceding embodiments, the fixing apparatuses were structured so that the fixation belt came into direct contact with the unfixed image on the recording medium. However, the present invention is also applicable to a fixing apparatus, the fixation belt of which tomes into contact with the opposite surface of the recording medium from the unfixed toner image on the recording medium.

As described above, the present invention can prevent the problem that when an object is heated by a heat belt type heating apparatus, it fails to separate from the heating belt or pressure roller of the heating apparatus, preventing thereby the object from being chaffed by the contact separation claws of the fixing apparatus. Further, the present invention makes it possible to eliminate the contact separation claws, making it therefore possible to provide a fixing apparatus which is lower in cost, and longer in service life, that is, a fixing apparatus which is lower in operational cost.

Therefore, the present invention makes it possible to provide an image forming apparatus, the fixing apparatus of which is a heating apparatus, and which is capable of outputting a desirable image, and lower in operational cost.

Also, the present invention makes it possible to make virtually straight the shape of the cross section of the nip portion of a belt type heating apparatus, even if the belt supporting rotational member and pressure applying rotational member of the heating apparatus are different in surface hardness. Therefore, the present invention makes it possible to improve the level of reliability at which recording medium is conveyed through the belt type fixing apparatus when the image forming apparatus equipped with the belt type fixing apparatus is in the two-sided print mode.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus comprising:

a both-side image forming means for forming images on both sides of a recording material;

a rotatable belt for heating a toner image on a recording material through a belt;

a rotatable supporting member, having an elastic layer, for supporting said belt; and a rotatable pressing member, pressed toward said supporting member with said belt interposed therebetween, for forming the nip for nipping and feeding the recording material;

wherein said pressing member has a surface hardness which is larger than a surface hardness of said rotatable supporting member, and wherein a surface hardness of said rotatable supporting member through said belt is different from a surface hardness of said rotatable pressing member by +4 degrees to −8 degrees.

2. An apparatus according to claim 1, wherein said rotatable pressing member has an elastic layer.

3. An apparatus according to claim 2, wherein the elastic layer of said rotatable supporting member has a thickness larger than a thickness of the elastic layer of said rotatable pressing member.

4. An apparatus according to claim 1, wherein said belt per se has a surface hardness which is larger than a surface hardness of said rotatable pressing member.

5. An apparatus according to claim 1, wherein said rotatable supporting member is disposed at a downstream-most position with respect to a feeding direction of the recording material by the nip.

6. An apparatus according to claim 1, wherein said belt has a base layer of metal.

7. An apparatus according to claim 1, further comprising a separation member which is out of contact from said belt or said rotatable pressing member.

* * * * *

UNITED STATES PATENT AND TRADEMARK OFFICE

CERTIFICATE OF CORRECTION

PATENT NO. : 7,016,638 B2
APPLICATION NO. : 10/763271
DATED : March 21, 2006
INVENTOR(S) : Kazuaki Ono et al.

It is certified that error appears in the above-identified patent and that said Letters Patent is hereby corrected as shown below:

COLUMN 2:
Line 19, “or” should read --of--.

COLUMN 3:
Line 61, “cross sectional” should read --cross-sectional--.

COLUMN 4:
Line 58, “cross” should read --cross- --.

COLUMN 9:
Line 54, “way” should read --may--.

COLUMN 10:
Line 22, “make,” should read --make--.

COLUMN 17:
Line 8, “fall” should read --fail--.

COLUMN 18:
Line 1, “or” should read --of--.

COLUMN 19:
Line 7, “is” should read --are--.

UNITED STATES PATENT AND TRADEMARK OFFICE

CERTIFICATE OF CORRECTION

PATENT NO. : 7,016,638 B2
APPLICATION NO. : 10/763271
DATED : March 21, 2006
INVENTOR(S) : Kazuaki Ono et al.

It is certified that error appears in the above-identified patent and that said Letters Patent is hereby corrected as shown below:

COLUMN 24:
Line 1, “streaky. Or” should read --streaky, or--.
Line 65, “tomes” should read --comes--.

Signed and Sealed this

Seventh Day of November, 2006

JON W. DUDAS
*Director of the United States Patent and Trademark Office*